US005141254A

United States Patent [19]

Ring

[11] Patent Number: 5,141,254

[45] Date of Patent: Aug. 25, 1992

[54] RETAIL COUPON DOCUMENT

[75] Inventor: Robert S. Ring, Montvale, N.J.

[73] Assignee: Larry Tucker, Inc., Woodcliff Lake, N.J.

[21] Appl. No.: 673,305

[22] Filed: Mar. 22, 1991

[51] Int. Cl.[5] ..... B42D 15/00

[52] U.S. Cl. ..... 283/105; 283/51; 283/56; 283/101; 283/901

[58] Field of Search ..... 283/56, 101, 105, 901, 283/51, 106, 103, 72

[56] References Cited

U.S. PATENT DOCUMENTS

| | | | |
|---|---|---|---|
| 3,632,995 | 1/1972 | Wilson | 283/56 |
| 3,734,544 | 5/1973 | Fishkin et al. | 283/56 |
| 4,011,985 | 3/1977 | Simson | 283/56 X |
| 4,307,900 | 12/1981 | Krautsack | 283/56 |
| 4,817,990 | 4/1989 | Krost | 283/56 X |
| 5,052,718 | 10/1991 | Gold | 283/105 |

*Primary Examiner*—Joseph M. Gorski
*Assistant Examiner*—Peter Dungba Vo
*Attorney, Agent, or Firm*—Burns, Doane, Swecker & Mathis

[57] ABSTRACT

A retail coupon document contains two paper coupons which are hidden from a coupon user, the coupons being for different values. The user selects and pulls one of two intersecting pull strips, thereby revealing one of the coupons and destroying the other, depending upon which pull strip is selected. The pull strips are formed by perforated division lines which are so arranged that each pull strip passes through one of the coupons, whereby the revealed (non-destroyed) coupon will possess perforations of one of the pull strips. The pull strips are oriented parallel to a longer dimension of each coupon and parallel to the grain of the paper.

6 Claims, 3 Drawing Sheets

RETAIL COUPON DOCUMENT

BACKGROUND OF THE INVENTION

This invention relates to retail coupon documents.

Previously proposed in Krost U.S. Pat. No. 4,817,990 is a retail coupon document in which two coupons (or values) are hidden from the consumer and wherein one of the coupons (or values) is destroyed by the consumer in response to opening the coupon document. A manufacturer is able to issue or sponsor such a coupon document in order to target the users of a competitor's product and present them with an incentive for switching to the sponsor's product. That is, each of the hidden coupons would present the consumer with a value (e.g., a discount) for using the sponsor's product. However, one of the coupons would offer a greater value than the other and would be directed to the user of the competitor's product.

Such direction would be accomplished by means of instructions imprinted on the front side of the document. Those instructions would be calculated to ensure that the opening technique employed by users of the competitor's product would result in the lesser value coupon being destroyed and the greater value coupon being revealed. Conversely, the opening technique employed by users of the sponsor's product would result in the greater value coupon being destroyed and the lesser value coupon being revealed. The greater value received by the user of the competitor's product would serve as an incentive to switch products.

The coupon document itself constitutes two paper panels glued together along their borders. Each panel thus presents a hidden side (which faces the hidden side of the other section) and an exposed side (which constitutes the front or rear side of the coupon document). Two coupons are imprinted on one of the inner sides in an overlapping fashion, and instructions for opening the coupon document are imprinted on one of the exposed sides. Those document-opening instructions require the user to sever the panels along predefined division lines which are visible to the user. The user is instructed to chose between two different division lines, depending upon whether the user is a user of the competitor's product or the sponsor's product. The user will reveal a coupon for the sponsor's product regardless of which division lines are chosen. However, the division lines presented to users of the competitor's product serve to destroy the lesser value coupon and reveal the greater value coupon, whereas the division lines presented to the user of the sponsor's product serve to destroy the greater value coupon and reveal the lesser value coupon.

It has been found that division lines comprised of, for example, conventional perforations such as disclosed in Fishkin U.S. Pat. No. 3,734,544, may present a serious shortcoming by excessively weakening the structural integrity of the revealed (surviving) coupon. That is, after the user opens the coupon document along a selected one of the perforated division lines, the revealed coupon will also possess the perforations of the non-selected division lines. The presence of those remaining perforations in the revealed coupon makes the revealed coupon susceptible to being accidentally separated along those perforations as a consequence of the coupon being handled by the user.

A variation of the Krost coupon document has been previously proposed in which the coupon includes a means or tool for tearing along the division lines, namely, a pair of zipper pulls which are integral with an upper one of the panels. Those zipper pulls form manually actuable tools which effectively cut through the upper panel (but not the other, bottom panel) along the perforated division lines when pulled by the user. Although this variation requires that only one of the panels of the coupon document be cut, it still embodies the earlier described shortcoming wherein the revealed coupon is excessively weakened by the presence of the non-selected perforated division lines.

It has been proposed that the zipper pulls extend parallel to one another whereby the pulling of one zipper pull destroys one coupon while creating a hole enabling the user to peel the other (non-destroyed) coupon off the lower panel. A space disposed on the hidden side of the upper panel and situated between the zipper pulls includes indicia which is common to both coupons and is retained with the non-destroyed coupon. Each of the coupons, when revealed, is of rectangular configuration having long and short sides. As noted above, the non-destroyed coupon will contain the perforations of the zipper pull which was not pulled by the user, thereby weakening the coupon. In particular, the perforations extend parallel to the short sides of the coupon.

It would be desirable to provide a coupon document type in which the revealed (non-destroyed) coupon exhibits a higher degree of integrity.

SUMMARY OF THE INVENTION

The present invention involves a retail coupon document comprising first and second panels which are removably joined together by adhesive along their peripheral edges. The first panel is formed of paper and includes an exposed outer side and a hidden inner side. The inner side is imprinted with coupon indicia to define first and second intersecting retail coupons which are mutually overlapped to form a common section therebetween The first panel includes first and second pull strips defined by first and second pairs of perforated division lines, respectively. The first pair of perforated division lines is offset from the first coupon and extends through the second coupon. The second pair of perforated division lines is offset from the second coupon and extends through the first coupon, so that a pulling of the first pull strip enables the first coupon to be revealed and the second coupon to be destroyed, and a pulling of the second pull strip enables the second coupon to be revealed and the first coupon to be destroyed. Each of the first and second coupons includes long and short dimensions. The long dimension extends in substantially the same direction as the grain of the paper from which the first panel is formed. Each of the pull strips has a length and a width, the length being longer than the width and oriented substantially parallel to the grain of the paper.

It is preferable that the coupons do not overlap one another, and that the pull strips be spaced apart by a distance which is less than a maximum width of each pull strip.

Each pull strip preferably includes a pre-cut leading end spaced inwardly from the perimeter of the first panel. Each pull strip extends to an edge of the first panel oriented perpendicular to the length of the pull strips.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
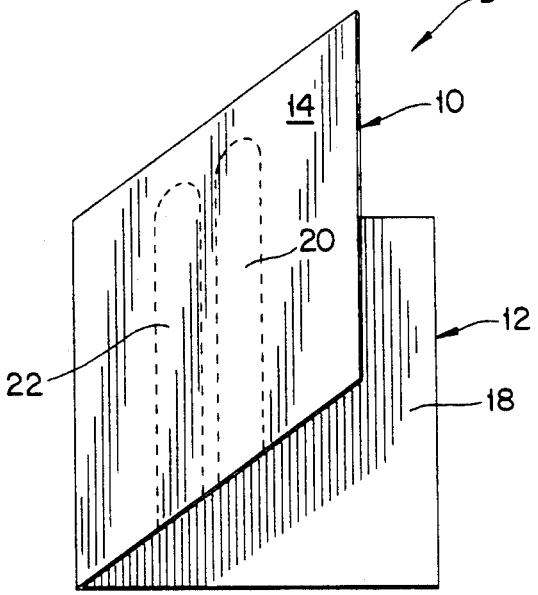
FIG. 1 is an exploded perspective view of a coupon document according to the present invention.

Depicted in FIG. 1 is a coupon document D according to the present invention in an exploded perspective view. That document comprises first and second rectangular panels 10, 12 which are glued together along their four peripheral borders. The glue is applied in four strips of narrow width, e.g., about one-half inch. The panels are formed of paper and the glue is of a type enabling the panels to be later peeled apart by a coupon user without destroying the paper or damaging the printing thereon, e.g., the glue can be a type available from the National Starch Co. of Bridgewater, N.J.

Figure 4:
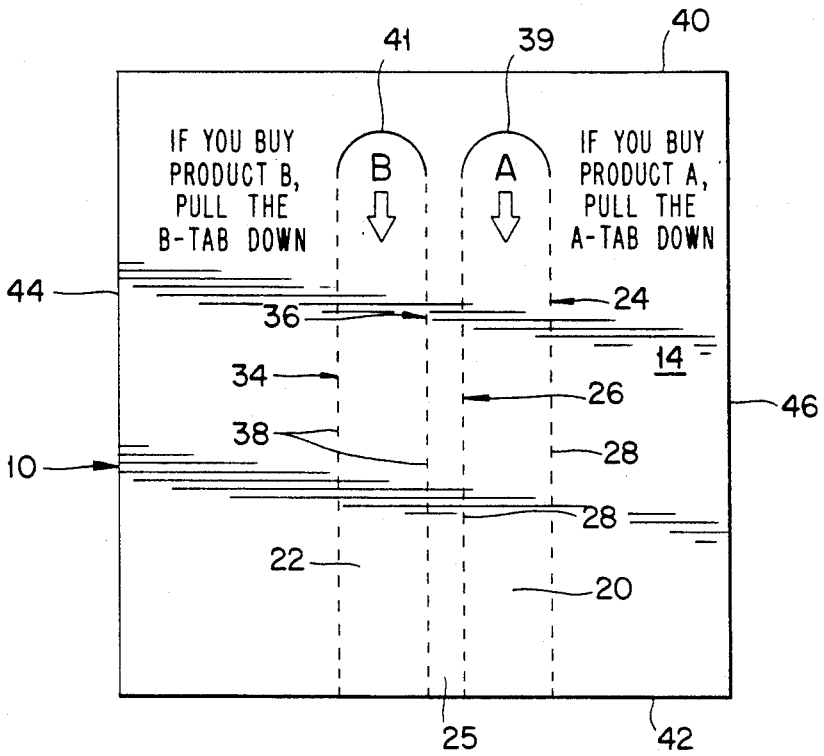
FIG. 4 is a front view of an exposed side of a front panel of the coupon document, with a pair of pull strips thereof being intact.
Figure 5:
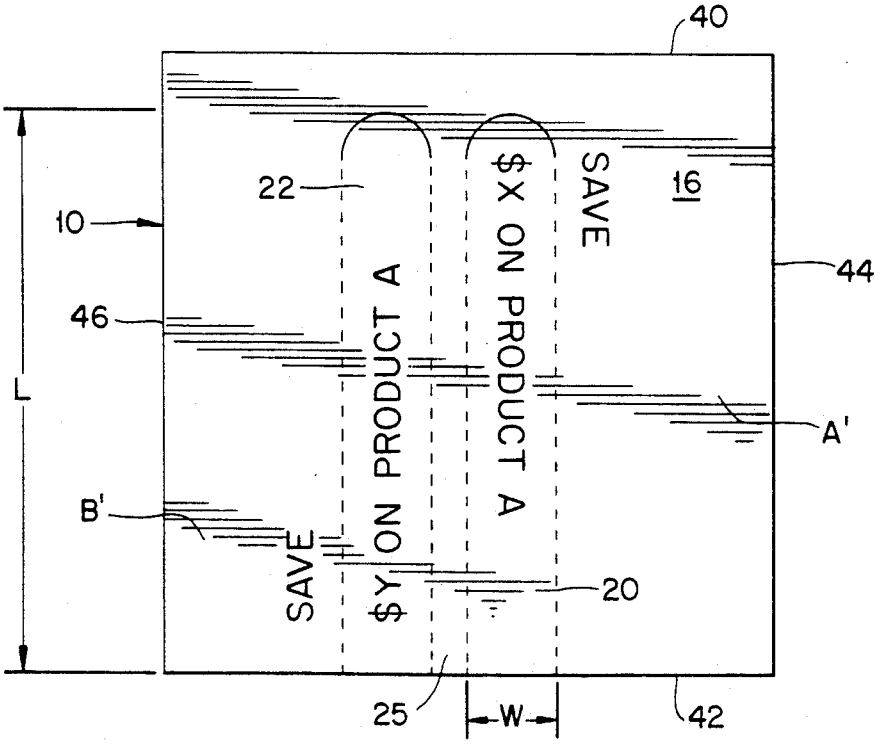
FIG. 5 is a view of a hidden side of the panel depicted in FIG. 4, with the pull strips still being intact.

The first panel 10 includes an outer exposed side 14 depicted in FIGS. 1 and 4, and an inner side 16 depicted in FIG. 5 (the latter side 16 being hidden once the panels have been glued together). The second panel 12 also has an exposed side (not shown) and an inner hidden side 18 (see FIG. 5) which faces the hidden side 16 of the first panel.

The first panel 10 is provided with first and second pull strips 20, 22 having end tabs marked A and B, respectively. The pull strips 20, 22 are spaced apart, i.e., are non-intersecting, and are preferably parallel. The width of the spacing 25 between the pull strips is very short and is less than the width W of each pull strip. The first pull strip 20 is defined by a set of division lines, i.e., two parallel division lines 24, 26, with each division line being formed by spaced perforations 28. Likewise, the second pull strip 22 is defined by a set of division lines, i.e., two parallel division lines 34, 36 formed by spaced apart perforations 38.

The first pull strip 20 has a leading edge 20A formed by a curved cut 39 and is spaced inwardly from an edge 40 of the first panel, and the second pull strip 22 also includes a leading edge 41 formed by a curved cut spaced inwardly from the edge 40. Both of the pull strips extend parallel to the remaining edges 44, 46 of the panel 10. The curved cuts 39, 41 enable a user to pull-up the leading edges so as to be able to grip and pull the pull strips. Both of the pull strips extend all the way to the opposing edge 42 of the first panel. It will be appreciated that each pull strip includes a length L extending parallel to edges 44, 46, and a width W extending parallel to edges 40, 42, the length L being substantially longer than the width W.

FIG. 5 depicts the hidden side 16 of the first panel 10. Two coupons A' and B' are imprinted on that hidden side 16 and are separated by the spacing 25. Thus, the coupons occupy respective sections of the side 16 and do not overlap.

The coupons A' and B' are imprinted with different values. For example, coupon A' provides a discount of X dollars, and the coupon B' provides a discount of Y dollars, with amount X being less than amount Y. Both coupons are valid only for the purchase of product A, however.

It will be appreciated that the first pull strip 20 is offset from the first coupon A', and the second pull strip 22 is offset from the second coupon B'.

It will also be appreciated that all of the first pull strip 20 extends through the second coupon B', and all of the second pull strip 22 extends through the first coupon A'.

From the foregoing, it will be apparent that if a user pulls the first pull strip 20, the latter will sever, and thus destroy, the second coupon B', whereas the first coupon A' will remain intact. Likewise, if the second pull strip 22 is pulled, the first coupon A' will be destroyed, and the second coupon B' will remain intact.

Figure 6:
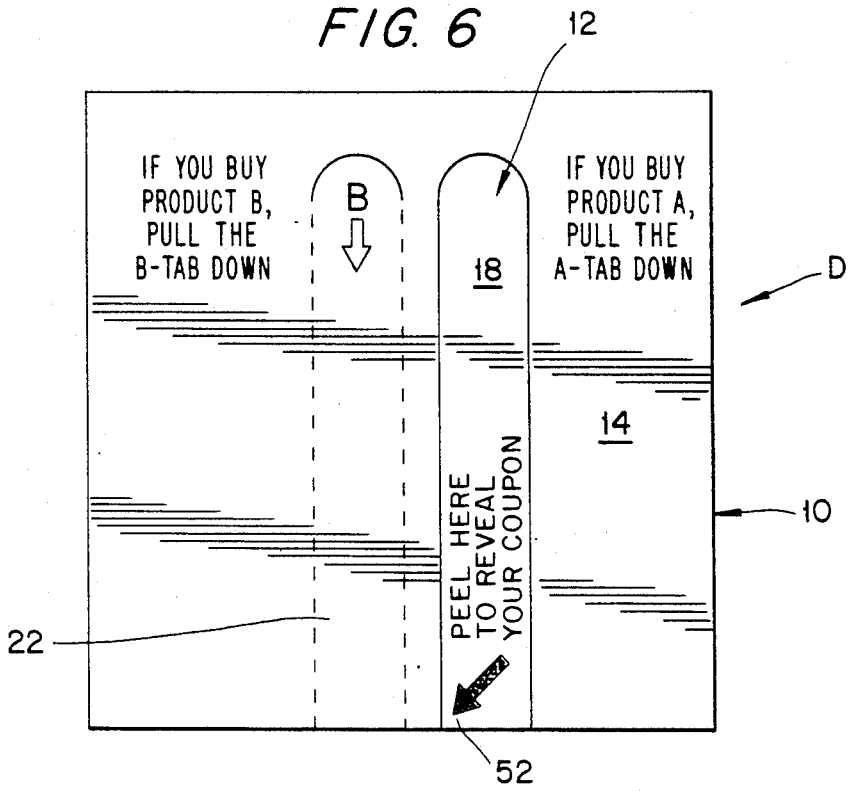
FIG. 6 is a view similar to FIG. 4 after one of the pull strips has been pulled off.
Figure 7:
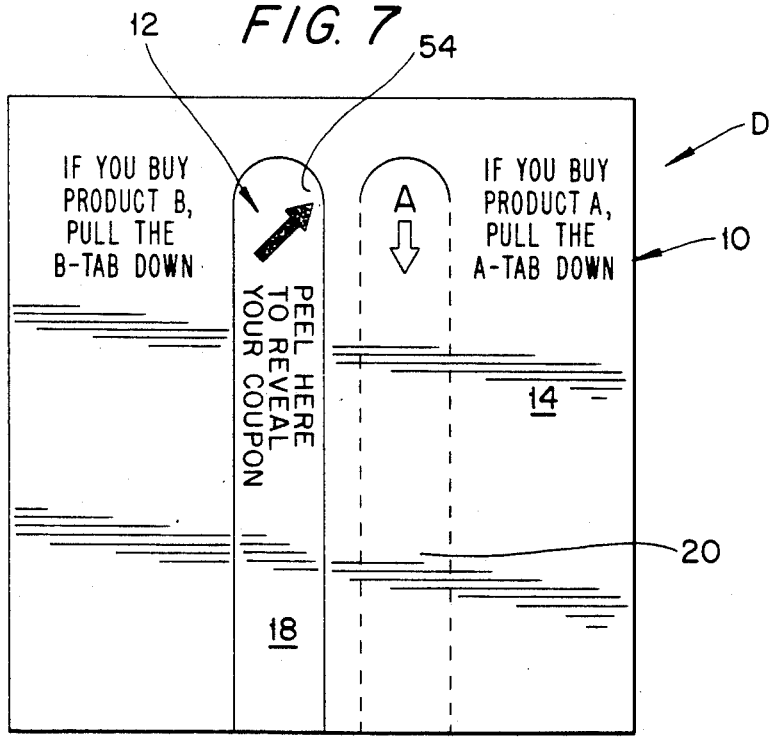
FIG. 7 is a view similar to FIG. 4 after the other pull strip has been pulled off.

Suitable instructions are imprinted on the inner (hidden) side 18 of the second panel 12 which become exposed once a respective one of the pull strips 20, 22 is pulled off. Those instructions are shown in FIGS. 6 and 7 which depict the front of the coupon document after the pull strips 20 and 22, respectively, have been pulled off. The instructions instruct the user where to peel the first panel in order to separate the first (or second) coupon from the second panel.

Figure 2:
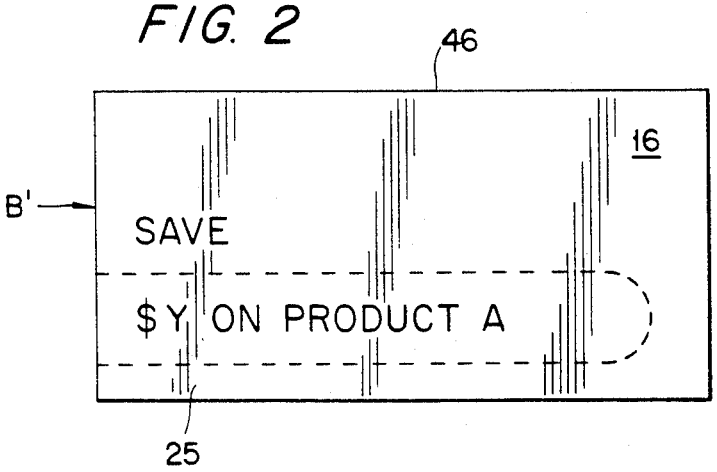
FIG. 2 is a front view of a first coupon which can be formed from the coupon document depicted in FIG. 1.
Figure 3:
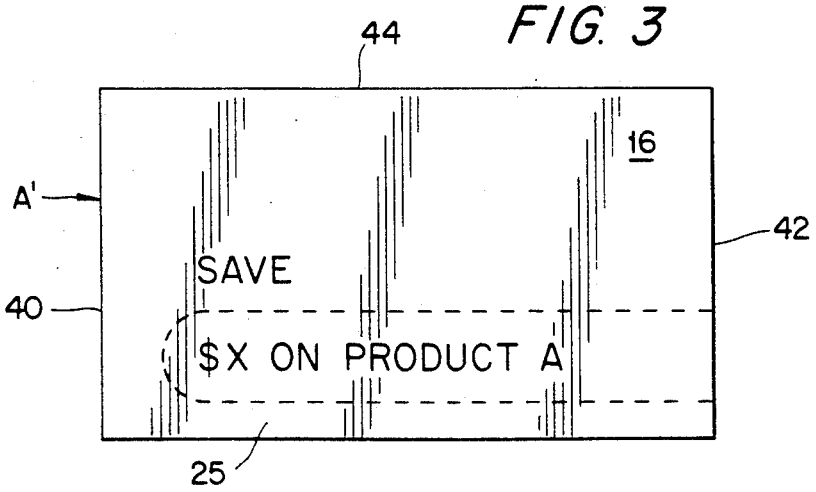
FIG. 3 is a front view of a second coupon which can be formed from the coupon document depicted in FIG. 1.

Thus, if the first pull strip A' has been pulled-off (see FIG. 6), the user is instructed to peel in the vicinity 52, whereby the first coupon A' is peeled off and revealed as shown in FIG. 3. On the other hand, if the user chooses instead to pull off the second pull strip 22, the exposed instructions will instruct the user to peel in a vicinity 54, whereupon the second coupon B', is peeled off and revealed as shown in FIG. 2. Only one of the two coupons A', B' can be revealed, since the revealing of one coupon is performedonly after the destruction of the other coupon.

Each of the revealed coupons is of generally rectangular configuration and includes a long dimension formed by a respective one of the edges 44, 46, and a short dimension formed by a portion of a one of the edges 40, 42.

Various types of offers can be made to the user, causing him to choose between the two pull strips 20, 22. For example, a manufacturer of product A may sponsor the distribution of the coupon document whose instructions will direct a user of product A to reveal the first coupon A', and direct a user of a competitor's product B to reveal the second coupon B'. As a result, the user of the competitor's product receives a greater discount for product A (i.e., amount Y being greater than amount X) in order to entice that user to switch to product A. That type of offer is merely exemplary; other types of offers could be made.

It will be appreciated that, regardless of which coupon is revealed, that revealed coupon will contain the perforated division lines of the non-chosen pull strip. Such perforations inherently weaken the coupon and may lead to an inadvertent destruction of the coupon as the result of normal handling by the user.

In accordance with the present invention, that problem is alleviated in that the pull strips extend parallel to the long dimension of its respective coupon, and the grain of the paper material is arranged to extend parallel to the long dimensions of the coupons. Accordingly, each of the revealed coupons A', B' will possess a perforated pull strip extending with the grain and in the direction of the long dimension of the coupon. The integrity and stability of the revealed coupon would be increased by such an arrangement as compared, for example, to an arrangement wherein the pull strips extend parallel to the short dimension of the coupon and perpendicularly to the grain of the paper.

It is also preferred that the perforations 28, 38 do not extend completely through the thickness of the panel, so as to avoid unduly weakening the coupon document.

The perforations can be of any desired arrangement, depending upon the balance which is desired between (1) the ease of removal of the chosen pull strip, and (2) the stability of the non-chosen pull strip in the revealed coupon. For example, each of the perforation lines 24, 26, 34, 36 could include eighteen perforations of $\frac{1}{8}$ inch length, and eighteen paper ties of $\frac{1}{8}$ inch length interconnecting successive perforations. The pull strips can be of about $\frac{1}{2}$ or $\frac{5}{8}$ inches in width W, or of any other desired width.

In operation, a user chooses one of the pull strips 20, 22 on the basis of the imprinted instructions. The user bends up the leading end of the chosen pull strip, with the aid of the pre-made cut 39 or 41, and then pulls off the pull strip.

The chosen pull strip travels parallel to, and spaced from, one of the coupons A', B' and through the other of the coupons so as to destroy the latter. If the first pull strip 20 was chosen, then the second coupon B' will have been destroyed, and instructions will appear (see FIG. 6) for peeling off the first coupon A' at vicinity 52. After being peeled off and revealed, the first coupon A' will appear as shown in FIG. 3.

Alternatively, if the second pull strip 22 is chosen, then the first coupon A' will be destroyed, and the second coupon B' will be revealed as shown in FIG. 2.

Regardless of which coupon is revealed, it will contain the non-chosen pull strip. However, since the length of that pull strip extends parallel to the grain of the paper and parallel to the longer dimension of the revealed coupon, the revealed coupon will exhibit a relatively high degree of stability for withstanding normal handling by the user.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A retail coupon document comprising first and second panels removably joined together by adhesive along their peripheral edges:

said first panel formed of paper having a grain and including an exposed outer side and a hidden inner side, said inner side being imprinted with coupon indicia to define first and second retail coupons, said first panel including first and second pull strips defined by first and second pairs of perforated division lines;

said first pair of perforated division lines being offset from said first coupon and extending through second coupon indicia of said second coupon, said second pair of perforated division lines being offset from said second coupon and extending through coupon indicia of said first coupon, so that a pulling of said first pull strip enables said first coupon to be revealed and said second coupon to be destroyed by the removal of second coupon indicia therefrom, and pulling of said second pull strip enables said second coupon to be revealed and said first coupon to be destroyed by the removal of said first coupon indicia therefrom, each of said first and second coupons including long and short dimensions, the long dimension extending in substantially the same direction as said grain of the paper from which said first panel is formed, each of said pull strips having a length and a width, said length being longer than said width and oriented substantially parallel to said grain of the paper.

2. The coupon document according to claim 1, wherein said pull strips are spaced apart by a distance less than a maximum width of each pull strips.

3. The coupon document according to claim 2, wherein said coupons do not overlap one another.

4. The coupon document according to claim 3, wherein each pull strip includes a pre-cut leading end spaced inwardly from the perimeter of said first panel, each pull strip extending to an edge of said first panel which is oriented perpendicular to said lengths of said pull strips.

5. The coupon document according to claim 1, wherein said coupons do not overlap one another.

6. The coupon document according to claim 1, wherein each pull strip includes a pre-cut leading end spaced inwardly from the perimeter of said first panel, each pull strip extending to an edge of said first panel which is oriented perpendicular to said length of said pull strips.

* * * * *